US010702908B2

(12) United States Patent
Nishizawa et al.

(10) Patent No.: US 10,702,908 B2
(45) Date of Patent: Jul. 7, 2020

(54) APPARATUS FOR CONVEYING MOLDED BODY FOR HEAT EXCHANGER FINS

(71) Applicant: HIDAKA SEIKI KABUSHIKI KAISHA, Tokyo (JP)

(72) Inventors: Junichi Nishizawa, Tokyo (JP); Keiichi Morishita, Tokyo (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/314,956

(22) PCT Filed: Oct. 20, 2016

(86) PCT No.: PCT/JP2016/081057
§ 371 (c)(1),
(2) Date: Jan. 3, 2019

(87) PCT Pub. No.: WO2018/073931
PCT Pub. Date: Apr. 26, 2018

(65) Prior Publication Data

US 2019/0321875 A1 Oct. 24, 2019

(51) Int. Cl.
*B21D 43/04* (2006.01)
*B65H 23/188* (2006.01)
(Continued)

(52) U.S. Cl.
CPC ..... *B21D 43/04* (2013.01); *B65H 20/22* (2013.01); *B65H 23/188* (2013.01); *B65H 23/28* (2013.01);
(Continued)

(58) Field of Classification Search
CPC ..... B65H 20/20; B65H 20/22
See application file for complete search history.

(56) References Cited

U.S. PATENT DOCUMENTS

2013/0134203 A1 5/2013 Karasawa et al.
2013/0160516 A1 6/2013 Karasawa et al.

FOREIGN PATENT DOCUMENTS

JP 1-288557 A 11/1989
JP 2006-21876 A 1/2006
(Continued)

OTHER PUBLICATIONS

International Search Report, issued in PCT/JP2016/081057, dated Dec. 27, 2016.
(Continued)

*Primary Examiner* — William E Dondero
(74) *Attorney, Agent, or Firm* — Birch, Stewart, Kolasch & Birch, LLP

(57) ABSTRACT

An apparatus for conveying a molded body for heat exchanger fins is capable of realizing high-speed conveying of the molded body for heat exchanger fins, of preventing the generation of noise during conveying, and of miniaturization. As a solution, an apparatus for conveying a molded body for heat exchanger fins has a plurality of conveying units, which each include a rotating conveyor driving unit and a rotating conveyor with a rotating shaft and rotating discs on which a plurality of protrusions that advance into the tube insertion portions of a heat exchanger fin are formed, disposed along a conveying direction of the metal strip, has a drive belt suspended between the rotating shafts of adjacent conveying units, and has an operation control unit that synchronizes rotational driving operations of the rotating shafts of the respective rotating conveyor driving units.

9 Claims, 10 Drawing Sheets

(51) Int. Cl.
*B65H 20/22* (2006.01)
*B65H 23/28* (2006.01)

(52) U.S. Cl.
CPC .. *B65H 2404/1115* (2013.01); *B65H 2404/52* (2013.01); *B65H 2701/173* (2013.01)

(56) References Cited

FOREIGN PATENT DOCUMENTS

| | | | |
|---|---|---|---|
| JP | 2013-110232 | A | 6/2013 |
| JP | 2013-111600 | A | 6/2013 |
| JP | 2013-128977 | A | 7/2013 |
| JP | 2014-30844 | A | 2/2014 |
| KR | 10-2013-0079178 | A | 7/2013 |

OTHER PUBLICATIONS

Korean Office Action 10-2019-7000729, dated Feb. 25, 2020; pp. 1-18.

A-A CROSS SECTION

APPARATUS FOR CONVEYING MOLDED BODY FOR HEAT EXCHANGER FINS

TECHNICAL FIELD

The present invention relates to an apparatus for conveying a molded body for heat exchanger fins that conveys a molded body for heat exchanger fins including a plurality of through-holes or a plurality of cutaway portions.

BACKGROUND ART

A heat exchanger, such as an air conditioner, is typically constructed by stacking a plurality of heat exchanger fins, in which a plurality of through-holes or cutaway portions have been formed to enable heat exchanger tubes to be inserted. Such heat exchanger fins can be manufactured by a manufacturing apparatus for heat exchanger fins 200 such as that depicted in FIG. 10. The manufacturing apparatus for heat exchanger fins 200 is equipped with an uncoiler 212, in which a thin metal plate 210 made of aluminum or the like as a thin plate material has been wound into a coil. The thin metal plate 210 pulled out from the uncoiler 212 via pinch rollers 214 is inserted into an oil applying apparatus 216 where machining oil is applied onto the surface of the thin metal plate 210, and is then supplied to a mold apparatus 220 provided inside a mold pressing unit 218.

The mold apparatus 220 internally includes an upper mold die set 222 that is capable of up-down movement and a lower mold die set 224 that is static. The mold apparatus 220 forms a plurality of collar-equipped through-holes or cutaway portions, where collars of a predetermined height are formed around through-holes, at predetermined intervals (in a matrix-like arrangement) in a predetermined direction. The result of machining the thin metal plate 210 to produce the through-holes or cutaway portions and the like is hereinafter referred to as the "metal strip 211".

The metal strip 211 that has been machined is formed in a state where a plurality of heat exchanger fins as products are aligned in the width direction. For this reason, an inter-row slit apparatus 225 is provided at a position downstream of the mold apparatus 220. The inter-row slit apparatus 225 cuts the metal strip 211, which is intermittently fed by a feeding apparatus 226 after formation by the mold pressing unit 218, into a predetermined product width using upper blades 225A and lower blades 225B that come together to form metal strips of the product width 211A in the form of strips that are long in the conveying direction.

The metal strips of the product width 211A formed by the inter-row slit apparatus 225 are cut into predetermined product lengths by a cutter 227 and thereby formed into heat exchanger fins 213 that are the intended product to be manufactured. The heat exchanger fins 213 formed in this way are stored in a stacker 228. The stacker 228 has a plurality of pins 229 that are erected in the vertical direction, and the heat exchanger fins 213 are stacked and held in the stacker 228 by inserting the pins 229 into the through-holes or the cutaway portions that have been formed in the heat exchanger fins 213.

CITATION LIST

Patent Literature

Patent Literature 1: Japanese Laid-open Patent Publication No. 2006-21876

SUMMARY OF INVENTION

Technical Problem

The feeding apparatus 226 in the conventional manufacturing apparatus for heat exchanger fins 200 conveys the metal strip 211 that has been molded by the mold apparatus 220 (the mold pressing unit 218) using an intermittent feeding mechanism called a "hitch feeding mechanism". With an intermittent feeding mechanism as represented by a hitch feeding mechanism, it is necessary to insert the hitch pins into the metal strip 211 when conveying the metal strip 211 and to withdraw the hitch pins from the metal strip 211 when returning the hitch feeding mechanism in the opposite direction to the conveying direction of the metal strip 211, which results in a limit for high-speed conveying of the metal strip 211. Also, when attempting to perform high-speed conveying of the metal strip 211 using a hitch feeding mechanism, collisions between the components constructing the hitch feeding mechanism generate noise and risk damaging the components constructing the hitch feeding mechanism.

This type of hitch feeding mechanism also uses a rotational force from the crank shaft (not illustrated) of the press mechanism of the mold pressing unit 218 (the mold apparatus 220) as a power source. More specifically, by converting the rotational operations of the press mechanism crank shaft via a cam and/or link mechanism to reciprocal movement and transmitting this reciprocal movement to the hitch feeding mechanism, the power source when reciprocally moving the hitch feeding mechanism in the conveying direction (the horizontal direction) of the metal strip 211 is realized. Since the hitch feeding mechanism separately requires a cam and/or link mechanism to obtain this power source, a larger amount of space is occupied inside the manufacturing apparatus 200 for heat exchanger fins, resulting in the problem of this obstructing efforts to miniaturize the manufacturing apparatus 200 for heat exchanger fins.

The present invention was conceived to solve the above problem and has a first object of enabling high-speed conveying of a metal strip (or "molded body for heat exchanger fins") that has been molded by a mold apparatus and, by conveying stably and with high precision, prevents deformation of the molded body for heat exchanger fins and the generation of noise when conveying the molded body for heat exchanger fins. The present invention has a second object of miniaturizing an apparatus for conveying a molded body for heat exchanger fins.

Solution to Problem

As a result of intensive research into solving the above problem, the present inventors conceived the configuration described below which is capable of solving the problem. That is, the present invention is an apparatus for conveying a molded body for heat exchanger fins that conveys, when manufacturing heat exchanger fins in which through-holes into which heat exchanger tubes are inserted or cutaway portions into which flattened tubes for heat exchanging are inserted are formed, a molded body for heat exchanger fins in a predetermined direction at a stage after formation of the through-holes or the cutaway portions in a thin metal plate but before cutting into predetermined lengths in a conveying direction, the apparatus including: a plurality of conveying units that are disposed along the conveying direction of the molded body for heat exchanger fins and each include a rotating conveyor that has a plurality of tapered protrusions that are capable of advancing into the through-holes or the cutaway portions and has a rotating shaft in a direction that is perpendicular, on a horizontal plane, to the conveying direction of the molded body for heat exchanger fins, and a rotating conveyor driving unit that rotationally drives the rotating conveyor about the rotating shaft; and an operation control unit that controls the plurality of rotating conveyor driving units so as to synchronize rotational speeds between the plurality of conveying units, wherein in conveying units that are adjacent in the conveying direction of the molded body for heat exchanger fins, the rotating conveyor driving units are disposed at alternating positions in a direction that is perpendicular on the horizontal plane to the conveying direction of the molded body for heat exchanger fins, and for rotating conveyors that are adjacent in the conveying direction of the molded body for heat exchanger fins, a power transmitting body is suspended between one end of one rotating conveyor and another end of another rotating conveyor.

By using the above configuration, it is possible to omit a configuration that reciprocally moves in the conveying direction when conveying a molded body for heat exchanger fins. By doing so, it is possible to convey a molded body for heat exchanger fins at high speed and to also prevent the generation of noise during conveying. Since a driving source for a rotating conveyor is provided in each conveying unit, a power transmitting mechanism that transmits power to each conveying unit is unnecessary, which makes it possible to miniaturize an apparatus for conveying a molded body for heat exchanger fins. For adjacent rotating conveyors, since a power transmitting body is suspended between a rotating conveyor driving unit end that is one end of a rotating conveyor and a free end that is another end, it is possible to prevent rotational displacements in the length direction of the rotating conveyors, even when twisting deformation has occurred in the length direction of the rotating conveyors. As a result, it is possible to smoothly convey a molded body for heat exchanger fins and possible to increase the conveying speed.

It is also preferable for a value of a difference in angular phase of the protrusions that advance into the through-holes or the cutaway portions of the molded body for heat exchanger fins between conveying units that are adjacent in the conveying direction of the molded body for heat exchanger fins to be equal to a value produced by dividing an angular interval of the protrusions formed on each rotating conveyor by a disposed number of the conveying units.

With the above configuration, it is possible to produce a state where the protrusions of at least one out of the conveying units disposed in the conveying direction of the molded body for heat exchanger fins are inserted into the through-holes or cutaway portions of the molded body for heat exchanger fins. This makes it possible to convey the molded body for heat exchanger fins in a more stable state.

It is preferable to also include a lower guide plate that supports a lower surface of the molded body for heat exchanger fins and an upper guide plate that covers an upper surface of the molded body for heat exchanger fins.

By doing so, it is possible to avoid fluctuations in the thickness direction of the molded body for heat exchanger fins during conveying of the molded body for heat exchanger fins. It is also possible to keep the insertion depth of the protrusions of the conveying units into the through-holes or cutaway portions formed in the molded body for heat exchanger fins constant, which makes it possible to stably convey the molded body for heat exchanger fins.

It is also preferable for the protrusions to be inserted, when a rotating conveyor driving unit has completed an operation in one cycle during intermittent feeding of the molded body for heat exchanger fins, in a direction perpendicular to a conveying plane at least one position out of the through-holes or cutaway portions of the molded body for heat exchanger fins.

By doing so, during conveying of a molded body for heat exchanger fins that is intermittently fed to the apparatus for conveying a molded body for heat exchanger fins, by holding the molded body for heat exchanger fins in a state where the protrusions are vertically erected at a fixed stop position at the end of one cycle operation in an intermittent feeding operation, it is possible to position the molded body for heat exchanger fins during machining. By inserting the protrusions in an optimal state into the through-holes or the cutaway portions of the molded body for heat exchanger fins in this way, it is possible to smoothly convey the molded body for heat exchanger fins at the start of conveying and to also prevent deformation of the molded body for heat exchanger fins.

It is also preferable for a value produced by dividing the angular interval of the protrusions on each rotating conveyor by the disposed number of conveying units to be 14° or below.

By doing so, it is possible to convey the molded body for heat exchanger fins more smoothly and to further prevent damage to the molded body for heat exchanger fins.

It is preferable for each rotating conveyor driving unit to be a servo motor.

By doing so, it is possible to more reliably synchronize conveying operations of the molded body for heat exchanger fins, and to set the operation conditions during synchronization more precisely.

It is also preferable for side surfaces of the protrusions to be formed in a shape that is capable of advancing into the through-holes or the cutaway portions in synchronization with rotation of the rotating shafts while maintaining a gap from the through-holes or the cutaway portions and capable of withdrawing from the through-holes or the cutaway portions while contacting the through-holes or the cutaway portions to convey the molded body for heat exchanger fins. It is even more preferable for at least part of the side surfaces of each protrusion to be formed by involute curves.

By doing so, when conveying the molded body for heat exchanger fins, it is possible to reduce the load on the through-holes or cutaway portions that is produced due to the protrusions advancing into and withdrawing from the through-holes or cutaway portions from advancement of the protrusions into the through-holes or cutaway portions until withdrawal, which makes it possible to smoothly convey the molded body for heat exchanger fins.

It is also preferable for a distance between the rotating shafts to be a value calculated as $P1\times(M+1/N)$, where P1 is a product pitch of the heat exchanger fins on the molded body for heat exchanger fins, M is an arbitrary integer, and N is a number of the rotating shafts.

By doing so, it is possible for the protrusions to advance in an optimal state into the tube insertion portions of the metal strip, which means that it is possible to smoothly convey the metal strip at a start of conveying and possible to prevent deformation of the metal strip.

Advantageous Effects of Invention

According to the configuration of the present invention, since the rotating conveyor driving units that are the driving source of the conveying units operate in synchronization, it is possible to convey a molded body for heat exchanger fins in a stable state without causing deformation and to convey with high precision and at high speed. Since there is no configuration that reciprocally moves along the conveying direction of the molded body for heat exchanger fins, it is possible to prevent the generation of noise and damage to the apparatus configuration even when the molded body for heat exchanger fins is conveyed at high speed. In addition, since a rotating conveyor driving unit is provided per conveying unit for conveying the molded body for heat exchanger fins, it is not necessary to provide a power transmitting mechanism that transmits power to the conveying units. By doing so, it is possible to greatly miniaturize the apparatus for conveying a molded body for heat exchanger fins.

Also, for adjacent rotating conveyors, since a power transmitting body is suspended between a rotating conveyor driving unit end that is one end of a rotating conveyor and a free end that is another end, it is possible to prevent twisting deformation in the length direction of the rotating conveyors (rotating shafts), even when the rotating conveyors are rotated at high speed. By doing so, there are no displacements in the direction of rotation of the positions of protrusions along the length direction of the rotating conveyors, even when the rotating conveyors are rotated at high speed, which means it is possible to smoothly convey a molded body for heat exchanger fins and to raise the conveying speed.

DESCRIPTION OF EMBODIMENTS

First Embodiment

Figure 1:
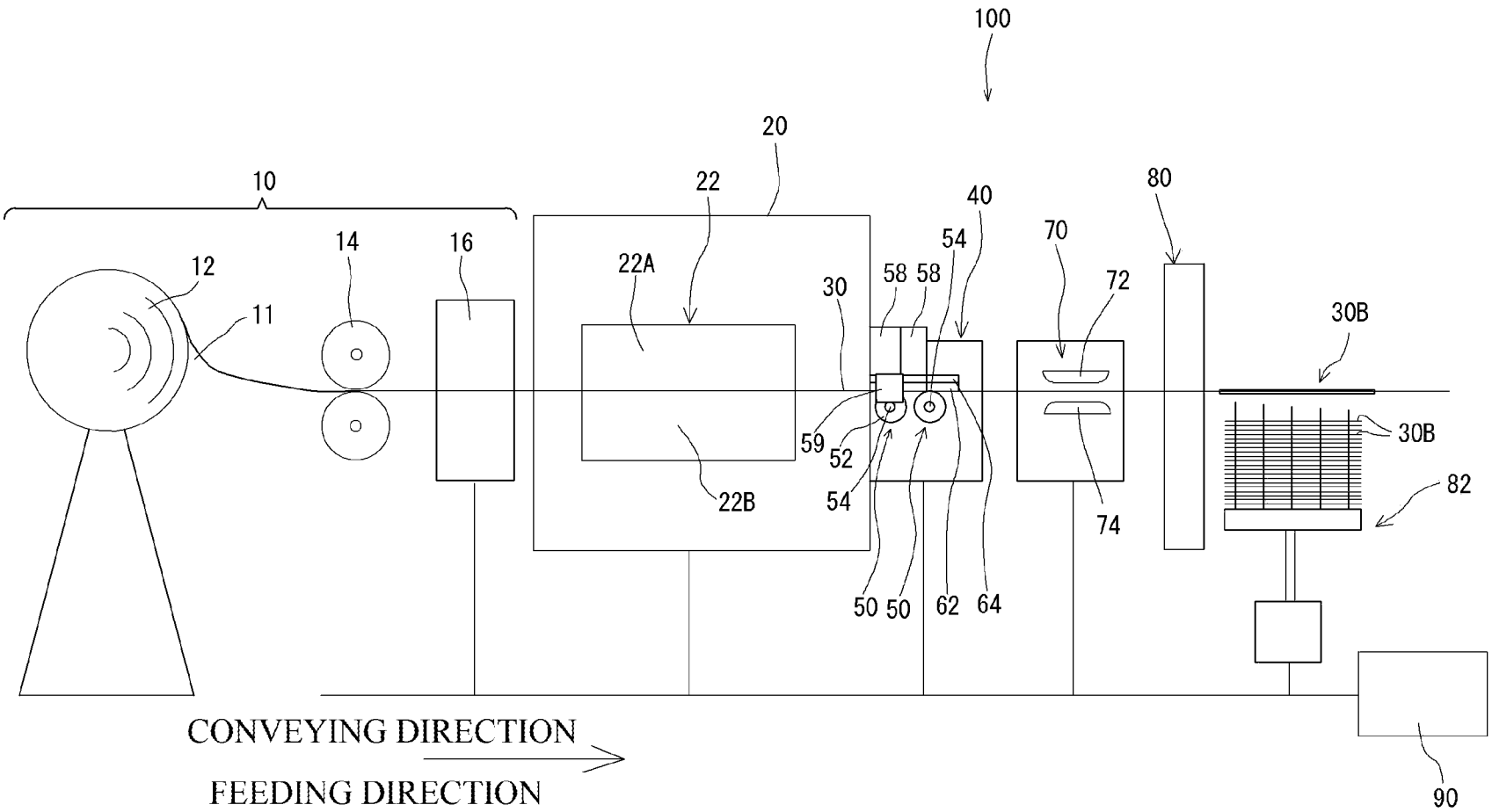
FIG. 1 is a side view depicting the overall configuration of a manufacturing apparatus for a molded body for heat exchanger fins according to a first embodiment.

The overall configuration of a manufacturing apparatus for a molded body for heat exchanger fins 100 according to an embodiment of the present invention is depicted in FIG. 1. Here, the concept of a "molded body for heat exchanger fins" refers to any of a metal strip obtained by press machining a thin metal plate using a mold pressing unit and a metal strip of product width produced by dividing such metal strip into the product width of heat exchanger fins. In other words, the expression "molded body for heat exchanger fins" refers to a metal strip in a state after through-holes or cutaway portions have been formed in the thin metal plate but before cutting into predetermined lengths in the conveying direction.

A thin metal plate 11, which is unmachined and is made of aluminum or the like that is the material for a molded body for heat exchanger fins, is wound into a coil in an uncoiler 12. The thin metal plate 11 pulled out from the uncoiler 12 is pulled out via pinch rollers 14, has machining oil applied to it by an oil applying apparatus 16, and is then intermittently fed to a mold pressing unit 20 that has a mold apparatus 22 disposed inside. With this configuration, a material supplying unit 10 is constructed by the uncoiler 12, the pinch rollers 14, and the oil applying apparatus 16. Note that this configuration of the material supplying unit 10 is a mere example, and the configuration of the material supplying unit 10 is not limited to the configuration described in this embodiment.

The mold apparatus 22 in the present embodiment includes an upper mold die set 22A and a lower mold die set 22B, with the upper mold die set 22A being provided so as to be capable of moving toward and away from the lower mold die set 22B. At the mold pressing unit 20 that includes the mold apparatus 22, a metal strip 30 of a predetermined shape, where tube insertion portions 31 as cutaway portions for inserting heat exchanger tubes, not illustrated, are formed in the thin metal plate 11, is formed.

Figure 2:
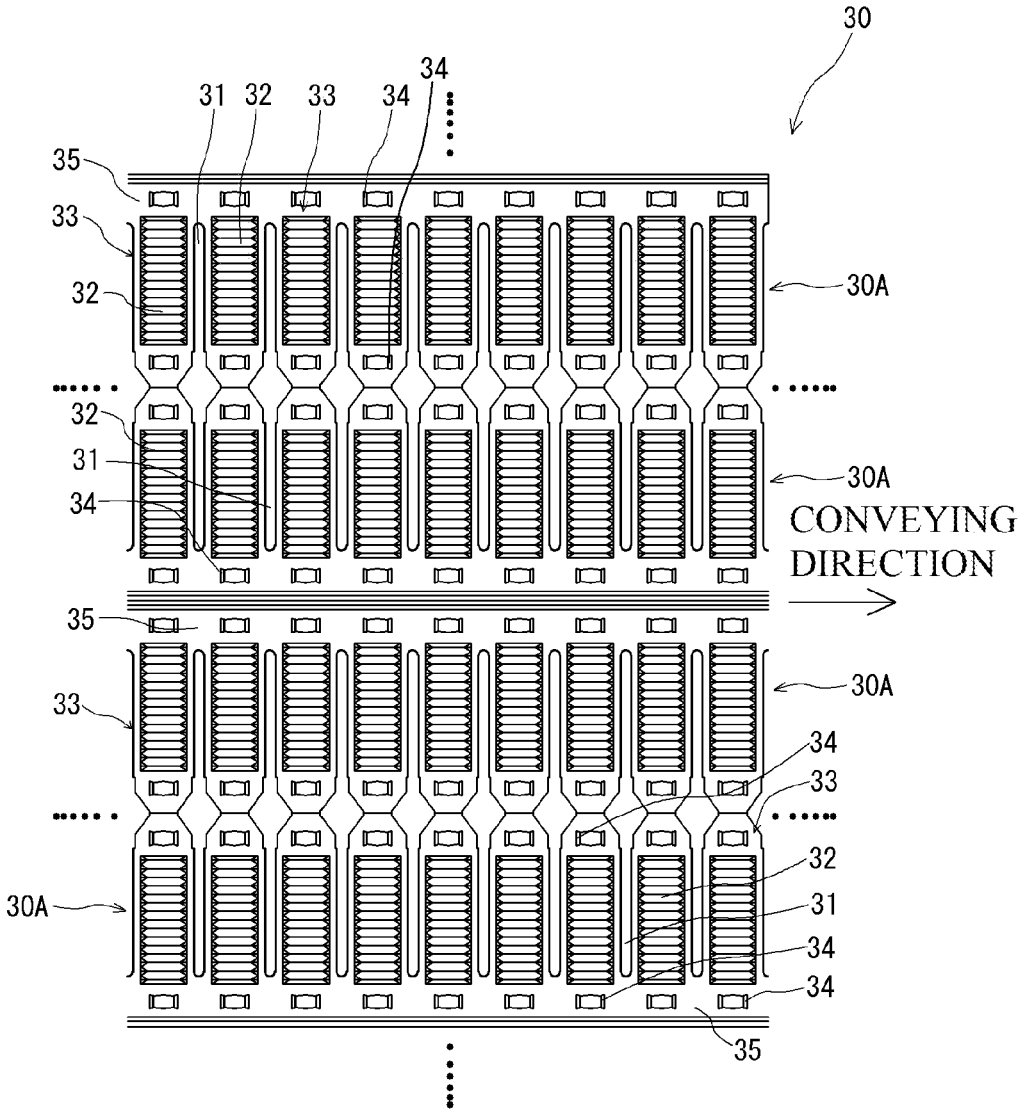
FIG. 2 is a plan view of a metal strip that has been machined by the mold apparatus in FIG. 1.

The metal strip 30 formed by the mold apparatus 22 is depicted in FIG. 2. The metal strip 30 depicted in FIG. 2 has a plurality of product strips (or metal strips of the product width 30A) formed in a line in a width direction that is perpendicular to a predetermined conveying direction (the direction of the horizontal arrow in FIG. 2) on a horizontal plane. The metal strip 30 is continuous in the conveying direction and in the direction that is perpendicular to the conveying direction on the horizontal plane, with FIG. 2 depicting only an extracted part of the metal strip 30.

On the metal strip 30, individual products (or heat exchanger fins 30B) obtained by fragmenting metal strips 30A of the product width each have a plurality of tube inserting portions 31, into which flattened tubes (not illustrated) as heat exchanger tubes for circulating a heat exchanger medium will be inserted, formed at a plurality of positions. Plate-like portions 33, where louvers 32 are formed, are formed between the respective tube inserting portions 31. Folded-up portions 34 formed by cutting and folding up parts of the plate-like portions 33 are also formed at both ends in the width direction of the louvers 32. Out of the two folded-up portions 34 formed for one louver 32, one folded-up portion 34 is formed at a front end-side of the plate-like portion 33.

The tube inserting portions 31 are formed from only one side in the width direction of the heat exchanger fins 30B as the final products. Accordingly, the plurality of plate-like portions 33 between the respective tube inserting portions 31 are joined by a joining portion 35 that extends in the length direction. Out of the two folded-up portions 34 for one louver 32 described above, the folded-up portion 34 on the other side is formed on the joining portion 35. Note that out of the parts of the plate-like portions 33 and the joining portion 35 that are not subjected to press-machining, parts that are continuous in the conveying direction of the metal strip 30 are regarded as "flat parts of the metal strip 30" (and referred to sometimes simply as the "flat parts" in the following description).

On the metal strip 30 depicted in FIG. 2, two metal strips of the product width 30A are disposed with the open ends of the tube inserting portions 31 adjacent to one another to form a pair, and two of such pairs are formed. That is, the pairs, in which the open ends of the tube inserting portions 31 of two products are disposed facing one another, are disposed so that the joining portions 35 thereof are adjacent.

The description will now return to the overall configuration of the manufacturing apparatus for a molded body for heat exchanger fins 100. The metal strip 30 formed in the mold apparatus 22 housed in the mold pressing unit 20 is conveyed intermittently in a predetermined direction (here, toward an inter-row slit apparatus 70) by an apparatus for conveying a molded body for heat exchanger fins 40 (hereinafter, simply referred to as the "conveying apparatus 40") which is provided downstream of the mold pressing unit 20. The feed timing of the conveying apparatus 40 is subjected to operation control by an operation control unit 90, described later, so as to operate in synchronization with (in concert with) operations of the mold pressing unit 20, which makes stable, intermittent feeding possible.

Figure 3:
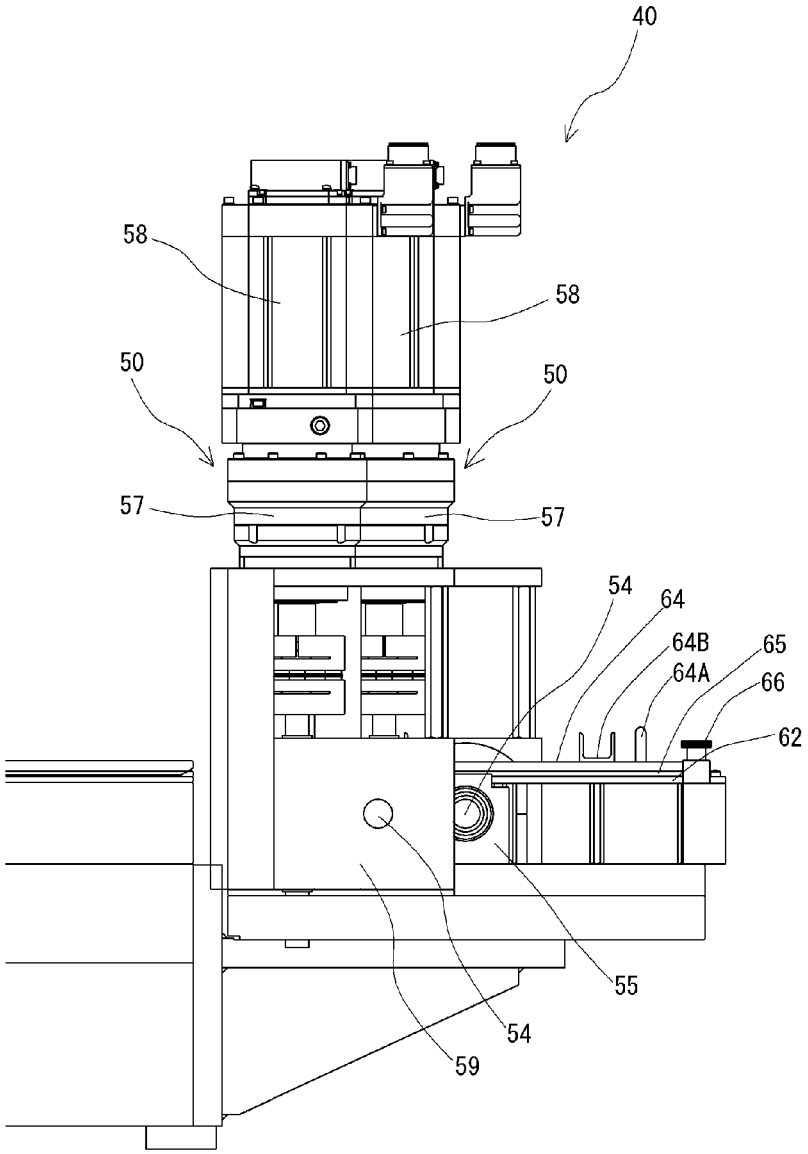
FIG. 3 is a side view of an apparatus for conveying a molded body for heat exchanger fins part in FIG. 1.
Figure 4:
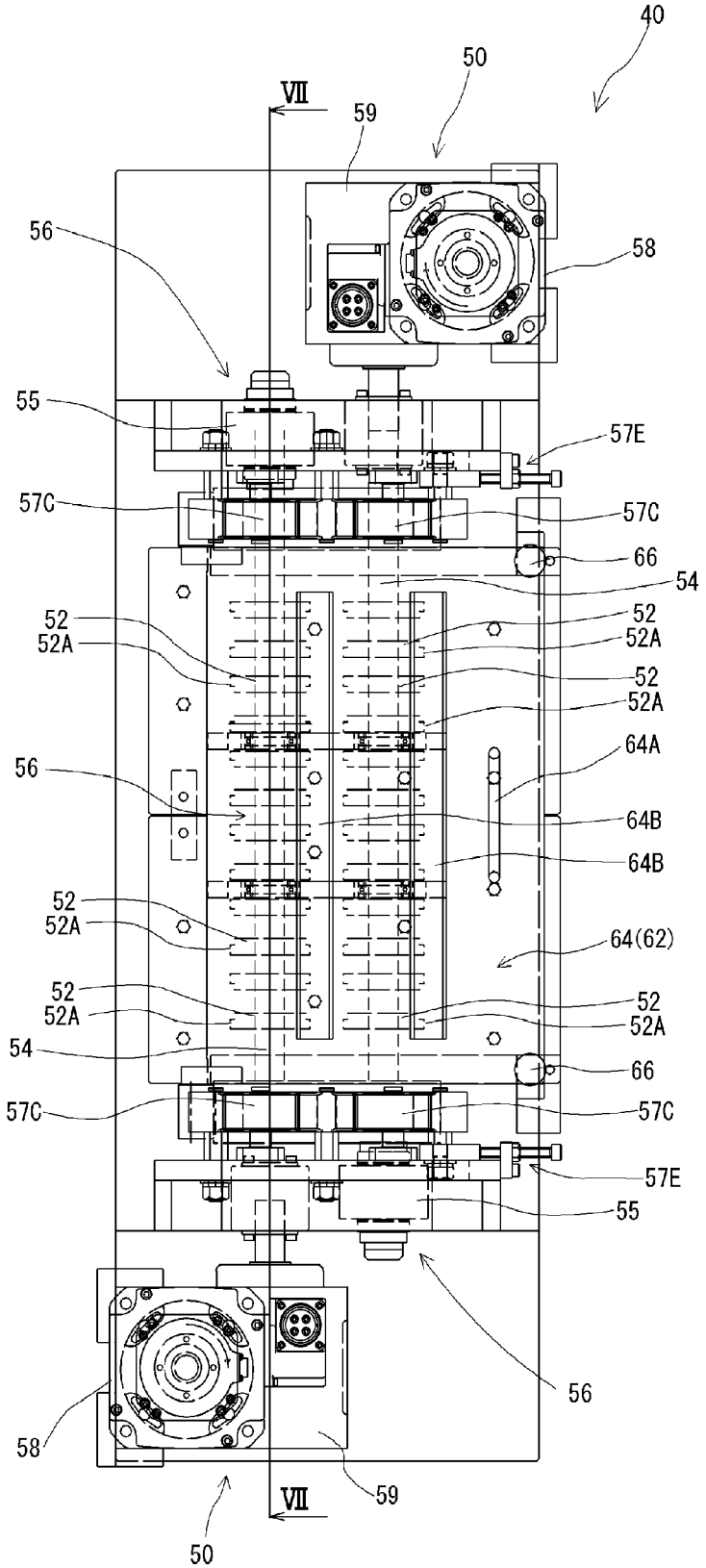
FIG. 4 is a plan view of the apparatus for conveying a molded body for heat exchanger fins part in FIG. 1.

As depicted in FIGS. 3 and 4, the conveying apparatus 40 according to the present embodiment is constructed of a plurality of conveying units 50 that are provided at necessary intervals in the conveying direction of the metal strip 30. Each conveying unit 50 is horizontally disposed in a direction that is perpendicular to the conveying direction of the metal strip 30 on the horizontal plane.

The conveying units 50 in the present embodiment each include a rotating conveyor 56 and a rotating conveyor driving unit 58 for rotatably driving the rotating conveyor 56 around a rotational axis that is perpendicular to the conveying direction of the metal strip 30 on the horizontal plane. Each rotating conveyor 56 is composed of a plurality of rotating discs 52 that have protrusions 52A formed on an outer circumferential surface thereof (i.e., that have a plurality of protrusions 52A) and a rotating shaft 54 that passes through the centers of the main surfaces of the rotating discs 52 and extends in a direction that is perpendicular to the conveying direction of the metal strip 30 on the horizontal plane.

In the present embodiment, a servo motor is used as each rotating conveyor driving unit 58 and the rotating conveyor driving unit 58 is coupled via a cam index 59 to the rotating shaft 54. Since the rotating conveyor driving unit 58 and the rotating shaft 54 are coupled via the cam index 59 in this way, even when the rotating conveyor driving unit 58 is driven at a constant speed, it is still possible to rotationally drive the rotating shaft 54 intermittently. Here, a cam profile that synchronizes to the press operations of the mold pressing unit 20 is used. The output shaft of each cam index 59 is formed with a cam profile that makes it possible to repeatedly execute conveying of a predetermined length of the metal strip 30 in the operation in one cycle in accordance with the disposed state of the protrusions 52A provided on the rotating discs 52.

It is also preferable for each cam index 59 to have a cam profile so that at the end of an operation of the manufacturing apparatus for a molded body for heat exchanger fins 100 in one cycle when intermittently feeding the metal strip 30, the insertion angle of the protrusions 52A that have advanced into tube insertion portions 31 of the metal strip 30 is upright in a direction that is perpendicular to the conveying plane. By causing the protrusions to advance in an optimal state into the tube insertion portions 31 of the metal strip 30 in this way, it is possible to smoothly convey the metal strip 30 at the start of conveying. Doing so is also favorable in that it is possible to prevent deformation of the metal strip 30.

Although it is possible to use a suitable interval (or distance between axes) as the interval for disposing the conveying units 50 with the configuration described above, it is preferable to use an interval (or distance between axes) that has been calculated according to the calculation formula depicted in Table 1.

$$L=P1\times(M+1/N)$$ Table 1 where L: distance between axes of conveying units

P1: pitch of molded products (product pitch)

M: arbitrary integer

N: disposed number of conveying units (number of axes of conveying units)

As depicted in FIG. 3 and FIG. 4, in each conveying unit 50, the rotating conveyor driving unit 58 is coupled to one end of the rotating shaft 54 and the other end of the rotating shaft 54 is held in a rotatable state by a holder 55, as represented by a bearing holder or the like. Each rotating conveyor driving unit 58 is coupled to a rotating shaft 54 (the output shaft of the servo motor) via a reducer 57 and the cam index 59 in a state where the rotating conveyor driving unit 58 is disposed offset to the upstream side in the conveying direction of the axis position of the center axis (rotational axis) of the rotating shaft 54 (the rotating conveyor driving units 58 may alternatively be offset to the downstream side). Conveying units 50 that are adjacent in the conveying direction of the metal strip 30 are provided so that the respective rotating conveyor driving units 58 alternate in a direction perpendicular to the conveying direction of the metal strip 30 on the horizontal plane.

By using this planar layout of conveying units 50, it is possible to dispose the rotating conveyor driving units 58 closer to the mold pressing unit 20. It is also possible to make the widths in the conveying direction of the plurality of rotating conveyor driving units 58 partially overlap in the conveying direction of the metal strip 30. That is, since it is possible to reduce the space occupied by the conveying apparatus 40, it also becomes possible to miniaturize the manufacturing apparatus for a molded body for heat exchanger fins 100.

Figure 5:
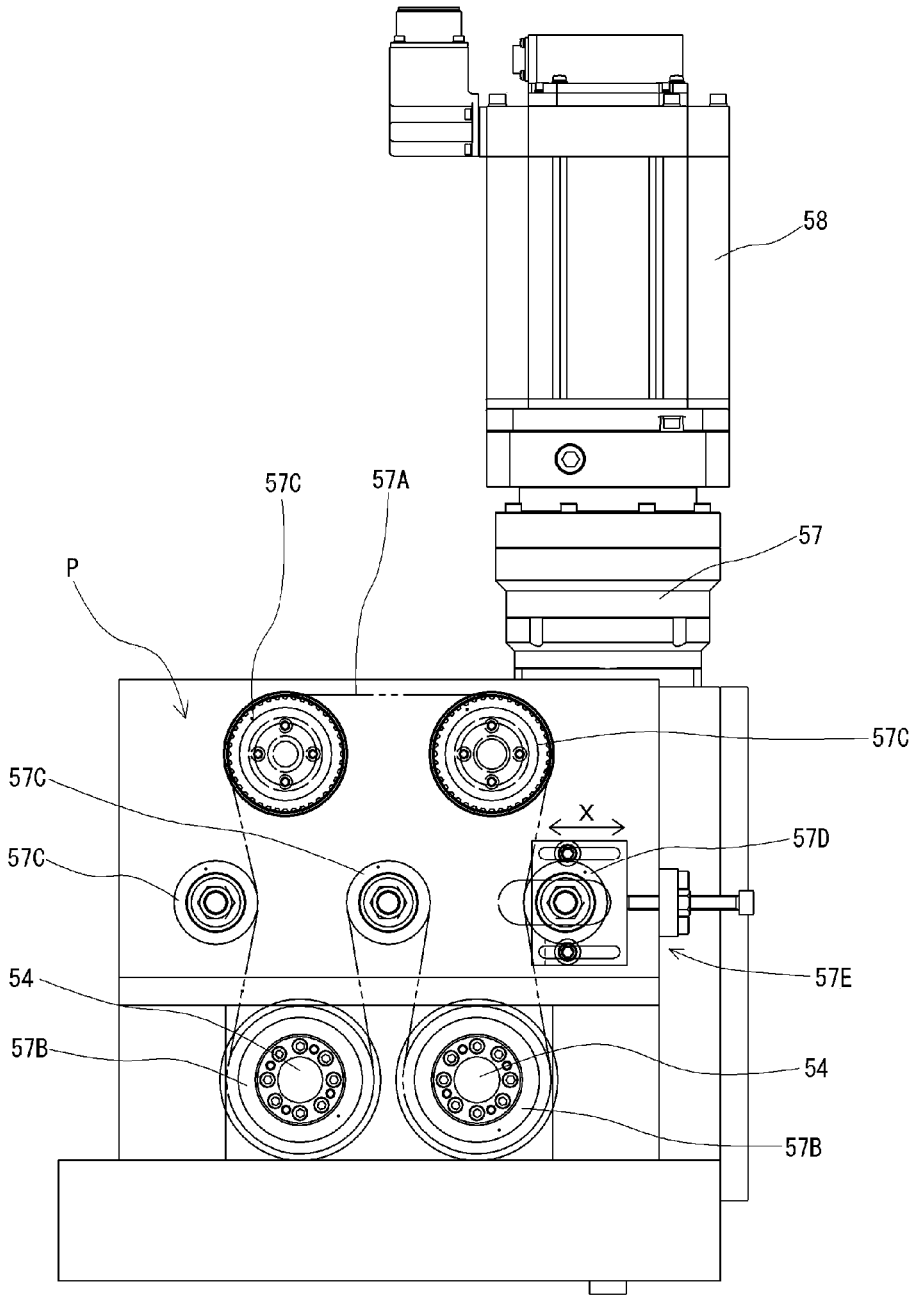
FIG. 5 is a schematic diagram useful in explaining the construction of a part where a drive belt is suspended on rotating shafts.

As depicted in FIG. 5, for conveying units 50 that are adjacent in the conveying direction of the metal strip 30, a drive belt 57A as a power transmitting body is suspended around the outer circumferential surfaces of the respective rotating shafts 54 at the rotating conveyor driving unit 58-end of the rotating shaft 54 of one conveying unit 50 (i.e., at the first end of that rotating shaft 54) and the holder 55-end of the rotating shaft 54 of the other conveying unit 50 (i.e., at the other end of that rotating shaft 54).

The drive belt 57A is suspended between a timing pulley 57B that is attached to the end of one rotating shaft 54 where the rotating conveyor driving unit 58 is attached (i.e., to the first end of that rotating shaft 54) and another timing pulley 57B that is attached to the end of the other rotating shaft 54 where the holder 55 is disposed (i.e., to the other end of that rotating shaft 54). Between the two timing pulleys 57B, idler pulleys 57C and a tensioner pulley 57D are rotatably attached to a pulley holder P disposed at both ends in a direction that is perpendicular to the conveying direction of the metal strip 30 on the horizontal plane. The drive belt 57A suspended between the two timing pulleys 57B is also suspended on the idler pulleys 57C and the tensioner pulley 57D.

The tensioner pulley 57D in the present embodiment is attached to the pulley holder P via a tension adjuster 57E. The tension adjuster 57E adjusts the tension of the drive belt 57A by moving (sliding) the attachment position of the tensioner pulley 57D relative to the pulley holder P in the direction of the arrow X in the drawing. In the present embodiment, a timing belt is used as the drive belt 57A.

In this way, by suspending the drive belt 57A between the first end and the other end of two rotating shafts 54 that are adjacent in the conveying direction of the metal strip 30, it is possible to prevent twisting deformation in the length direction of the rotating shafts 54 when the rotating shafts 54 are rotationally driven. By doing so, it is possible, when the rotating shafts 54 are rotated, to prevent positional displacements in the direction of rotation of the protrusions 52A formed on the rotating discs 52 attached to the rotating shafts 54. That is, even when the rotating shafts 54 are made longer (i.e., the width dimension of the metal strip 30 is increased) or the conveying speed of the metal strip 30 is increased, it is possible to cause the protrusions 52A to dependably advance into the tube insertion portions 31 of the metal strip 30, which makes it possible to convey the metal strip 30 with high reliability.

Although a configuration where the rotating conveyor driving unit 58 of each conveying unit 50 is coupled via a reducer 57 and a cam index 59 to a rotating shaft 54 is used in the present embodiment, it is also possible to use a configuration where the rotating conveyor driving units 58 are coupled to the rotating shafts 54 via only the cam indexes 59, a configuration where the rotating conveyor driving units 58 are coupled to the rotating shafts 54 via only the reducers 57, and a configuration where the output shafts of the rotating conveyor driving units 58 are directly coupled to the rotating conveyors 56 (i.e., to the rotating shafts 54). That is, there are no particular limits on how the rotating conveyors 56 (the rotating shafts 54) and the rotating conveyor driving units 58 are coupled. In addition, the operation of the rotating conveyor driving unit 58 in each conveying unit 50 is controlled by the operation control unit 90 so that the respective rotational driving operations are synchronized (i.e., the rotational speed is synchronized) with the press operations of the mold pressing unit 20 (i.e., the intermittent feeding operations of the metal strip 30).

A number of rotating discs 52 that is equal to or fewer than the number of tube insertion portions 31 formed in the width direction of the metal strip 30 are attached to each rotating shaft 54. The protrusions 52A formed on the outer circumferential surface of each rotating disc 52 should preferably be formed so that upper end portions become gradually narrower as the distance from the outer circumferential surface of the rotating disc 52 (i.e., from the base portions of the protrusions 52A) increases. In other words, the protrusions 52A should preferably be tapered. More specifically, it is preferable for the side surfaces of each protrusion 52A to be formed so as to be capable of advancing into a tube insertion portion 31 in synchronization with the rotation of the rotating shaft 54 in a state where gaps from the tube insertion portion 31 are maintained and capable of withdrawing from the tube insertion portion 31 while contacting the tube insertion portion 31 to feed the metal strip 30. In more detail, in the direction of rotation when the rotating discs 52 convey the metal strip 30, it is preferable for at least a front surface part out of the outer surfaces (side surfaces) of each protrusion 52A to be a curved surface formed by involute curves.

The angular interval between the protrusions 52A formed in this way around the outer circumferential surface of the rotating disc 52 is preferably such that a value produced by dividing the angular interval of the protrusions 52A on the outer circumferential surface of the rotating discs 52 by the disposed number of conveying units 50 is 14° or below. By disposing the protrusions 52A at intervals of this angle, it is possible for the conveying units 50 to smoothly insert and withdraw the protrusions 52A into and from the tube insertion portions 31 that are the through-holes or cutaway portions of the metal strip 30. The present applicant has clarified through experimentation that it is possible to smoothly convey the metal strip 30 with this configuration.

Figure 6:
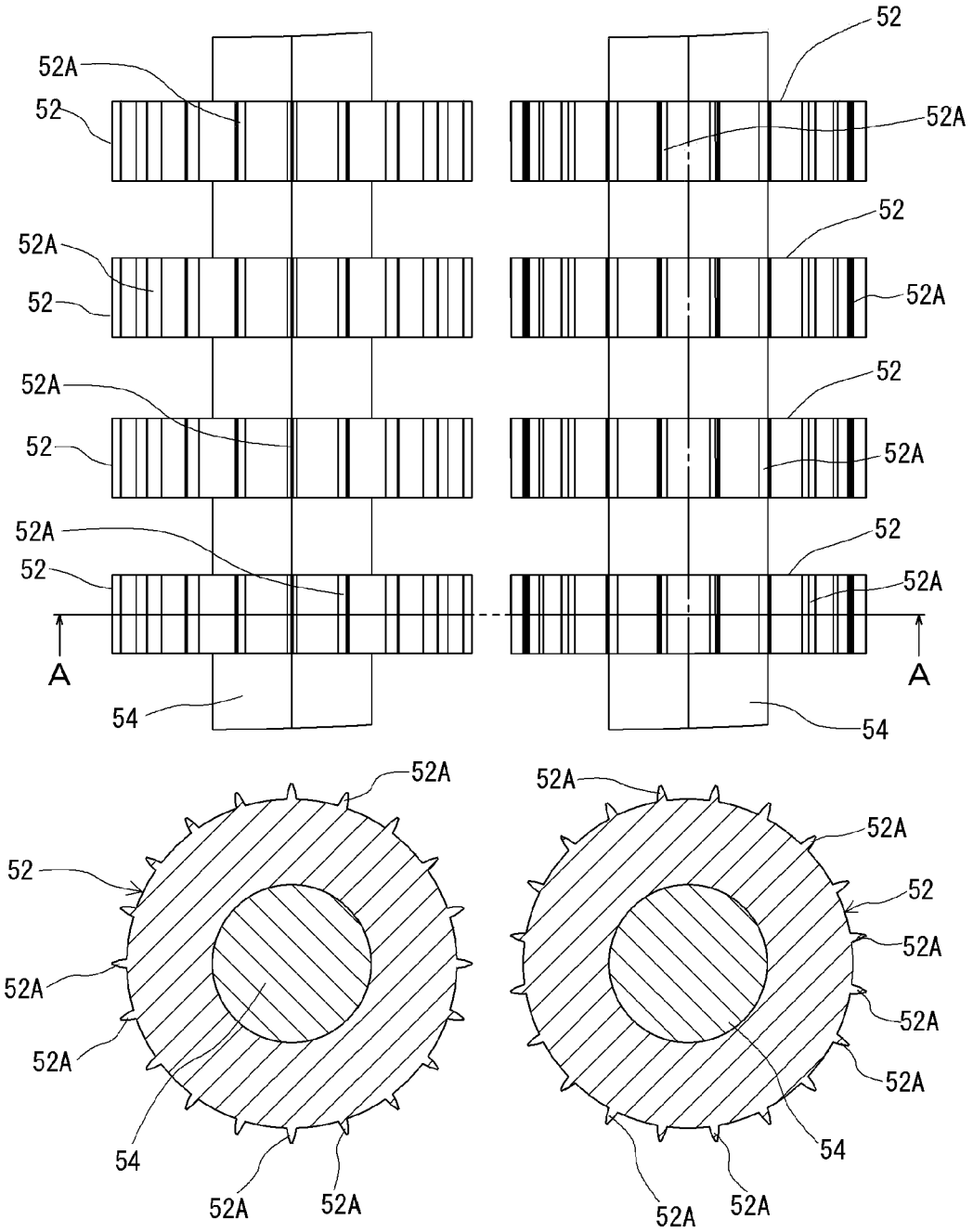
FIG. 6 is a diagram useful in explaining a state of protrusions of rotating discs in each conveying unit.

As depicted in FIG. 6, the positions of the respective protrusions 52A on the rotating discs 52 in the same conveying unit 50 are arranged in a straight line in the length direction of the rotary shaft 54. In other words, when a rotating conveyor 56 (the rotating shaft 54) rotates, the timing at which the protrusions 52A pass a specified position in the rotating direction of the rotating conveyor 56 matches for every rotating disc 52 along the length direction of the rotating conveyor 56. By using a plurality of conveying units 50 with the same construction that are formed in this way, it is possible to set the protrusions 52A of the respective conveying units 50 so that the timing at which the protrusions 52A become perpendicular to the conveying plane (that is, the horizontal plane) has uniform intervals.

By doing so, when the conveying units 50 convey the metal strip 30, it is possible to synchronize the insertion and withdrawal timing of the protrusions 52A into the tube insertion portions 31 in the conveying direction of the metal strip 30. Since it is possible to distribute the load on the tube insertion portions 31 when conveying the metal strip 30, it is possible to prevent deformation of the metal strip 30. Doing so is also favorable because it facilitates increases in the conveying speed of the metal strip 30.

It is also preferable for the disposed number of conveying units 50 that construct the conveying apparatus 40 and the timing at which the protrusions 52A of the rotating discs 52 of the respective conveying units 50 become perpendicular to the conveying plane (i.e., the horizontal plane) to have uniform intervals. In the present embodiment, since the conveying apparatus 40 is constructed of two conveying units 50, the angular phase difference of the protrusions 52A in the respective conveying units 50 is set at an angular interval given by dividing the angular interval at which the protrusions 52A formed on the rotating discs 52 are disposed by 2. That is, by coupling the output shaft of the cam index 59 with another rotating shaft 54 at a position with an angular interval with respect to a given rotating shaft 54 equal to a value given by dividing the angular interval at which the protrusions 52A formed on the rotating discs 52 are disposed by 2, an angular phase difference with respect to a state where the protrusions 52A are upright in a direction perpendicular to the conveying plane is provided.

By providing an angular phase difference between the protrusions 52A of the conveying units 50 as described above, it is possible for the protrusions 52A of one conveying unit 50 out of the plurality of conveying units 50 disposed along the conveying direction to advance into and withdraw from the tube insertion portions 31. That is, it is possible to make the external force that acts upon the metal strip 30 during conveying a constant magnitude, which is favorable in that it is possible to avoid deformation of the metal strip 30 and to perform smooth conveying.

In the present embodiment, a lower guide plate 62 that performs guiding (i.e., supports the lower surface of the metal strip 30) so that a lower surface height of the metal strip 30 is at the same height across a range of a required length is disposed at an exit position of the mold pressing unit 20 (see FIGS. 3 and 4). The lower guide plate 62 is provided across a range that extends from upstream of the plurality of conveying units 50 to a position downstream.

The lower guide plate 62 may be a single integral structure, or alternatively separate parts may be provided at upstream, intermediate, and downstream positions relative to the conveying units 50.

Figure 7:
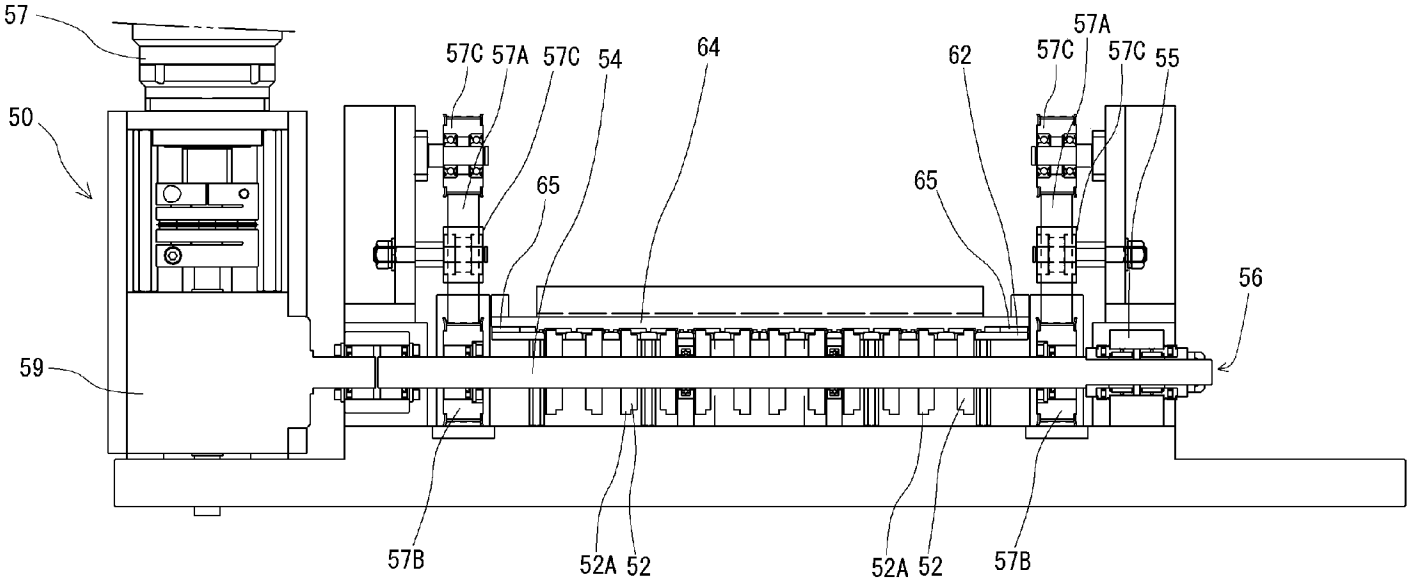
FIG. 7 is a cross-sectional view along a line VII-VII in FIG. 4.
Figure 8:
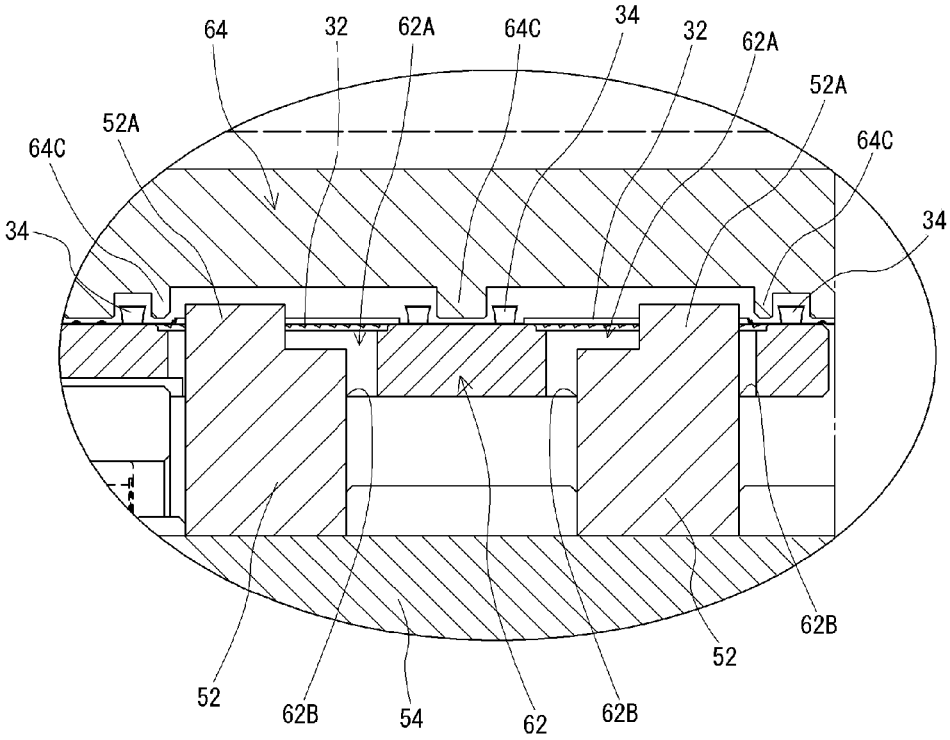
FIG. 8 is an enlarged view of a principal part in FIG. 7.

As depicted in FIG. 7 and FIG. 8, concave channels 62A are formed in the upper surface of the lower guide plate 62 in the present embodiment so as to correspond to the metal strips of the product width 30A in the width direction of the metal strip 30. Note that to simplify FIG. 7, parts are depicted without hatching. The concave channels 62A of the lower guide plate 62 are formed at positions that correspond to the formation positions of the tube insertion portions 31 in the metal strip 30.

Through-holes 62B that pass through in the thickness direction are formed in the concave channels 62A of the lower guide plate 62 and the rotating discs 52 of the conveying units 50 are housed in a state where parts of the protrusions 52A (the rotating discs 52) protrude through the through-holes. The front end parts of the protrusions 52A are provided so that when the protrusions 52A are upright with respect to the conveying plane (when the intermittent feeding operation in one cycle of the metal strip 30 has ended), the front ends are positioned higher than the upper surface height of the lower guide plate 62. The concave channels 62A are also formed at positions corresponding to the disposed positions of the louvers 32 formed in the metal strip 30, which prevents contact between the lower guide plate 62 and the louvers 32 when the metal strip 30 is conveyed.

An upper guide plate 64 that is capable of covering the upper surface of the metal strip 30 is disposed on the upper surface of the lower guide plate 62. The upper guide plate 64 is provided so as to be switchable (rotatable) between a state where the upper guide plate 64 is placed over the lower guide plate 62 and a state where the upper guide plate 64 is lifted up with an edge portion on the mold pressing unit 20 side as the axis of rotation. When a conventional metal strip 30 is conveyed, the upper guide plate 64 is placed over the lower guide plate 62 with a predetermined gap in the thickness direction in between. This gap is formed by spacers 65 disposed between the lower guide plate 62 and the upper guide plate 64.

A handle 64A and a reinforcing member 64B are attached to an upper surface of the upper guide plate 64, and convex portions 64C are disposed on the lower surface of the upper guide plate 64 at positions that contact the flat parts of the metal strip 30. It is also preferable to dispose guide plate pressing bolts 66 as guide plate fixtures. In a state where the spacers 65 are disposed between the lower guide plate 62 and the upper guide plate 64, the lower guide plate 62 and the upper guide plate 64 are attached in a state where the plates are fastened by the guide plate pressing bolts 66.

When (only when) variations (fluctuations) occur in the thickness direction of the metal strip 30 discharged from the mold pressing unit 20, such fluctuations in the metal strip 30 are regulated by contact with the convex portions 64C of the upper guide plate 64. By doing so, fluctuations in the insertion depth of the protrusions 52A of the conveying units 50 into the tube insertion portions 31 as the through-holes or cutaway portions of the metal strip 30 are suppressed and it is possible to keep the height of the conveying plane of the metal strip 30 at a predetermined height. Since this regulation of fluctuations in the thickness direction is achieved by the convex portions 64C contacting the flat parts of the metal strip 30, deformation of the metal strip 30 does not occur.

The inter-row slit apparatus 70 is provided downstream of the conveying apparatus 40. The inter-row slit apparatus 70 includes upper blades 72 that are disposed above the metal strip 30 and lower blades that are disposed below the metal strip 30. Although the power source of the inter-row slit apparatus 70 may be an independently provided power source, it is also possible to drive the inter-row slit apparatus 70 using the up-down operations of the mold pressing unit 20. The upper blades 72 and the lower blades 74 of the inter-row slit apparatus 70 are formed so as to be elongated in the conveying direction, and by cutting the metal strip 30 that is intermittently conveyed with the upper blades 72 and the lower blades 74 that come together, the metal strips of the product width 30A that are preforms for products that are elongated in the conveying direction are formed. Although the inter-row slit apparatus 70 is disposed on a downstream side of the conveying apparatus 40 here, the inter-row slit apparatus 70 may be disposed at a position upstream of the conveying apparatus 40.

The plurality of metal strips of the product width 30A that have been cut to the product width by the inter-row slit apparatus 70 are fed inside a cutoff apparatus 80 where the respective metal strips of the product width 30A are cut into predetermined lengths in the conveying direction. By doing so, it is possible to obtain heat exchanger fins 30B that are the final products. A plurality of heat exchanger fins 30B are stacked on top of each other in a stacker apparatus 82, and when a predetermined number of heat exchanger fins 30B have been stacked, the heat exchanger fins 30B are conveyed to a next process where a heat exchanger, not illustrated, is assembled.

The manufacturing apparatus for a molded body for heat exchanger fins 100 according to the present embodiment has the operation control unit 90 which includes a CPU and a storage unit, neither of which is illustrated. An operation control program for operation control of the various configurations that construct the manufacturing apparatus for a molded body for heat exchanger fins 100 is stored in advance in the storage unit of the operation control unit 90, with the CPU reading out the operation control program from the storage unit and performing operation control of the various configurations in accordance with the operation control program. By performing operation control of the various configurations using the CPU and the operation control program in this way, it is possible to coordinate a series of operations of the various configurations of the manufacturing apparatus for a molded body for heat exchanger fins 100.

The operation control unit 90 controls the operation of the rotating conveyor driving units 58 so as to synchronize the rotation operations of the individual rotating shafts 54 and to also synchronize with the rotation of the crank shaft of the mold pressing unit 20. When one cycle (i.e., the operation in one cycle) of intermittent feeding of the metal strip 30 has ended, the protrusions 52A of one set of the rotating discs 52 will be upright in a direction that is perpendicular to the conveying plane of the metal strip 30. More specifically, the output shaft of the cam index 59 and the rotating shafts 54 are coupled so as to produce a state where the positions of the protrusions 52A of the rotating discs 52 are upright at an operation start position of an intermittent operation (one cycle operation) of the cam index 59.

Second Embodiment

Figure 9:
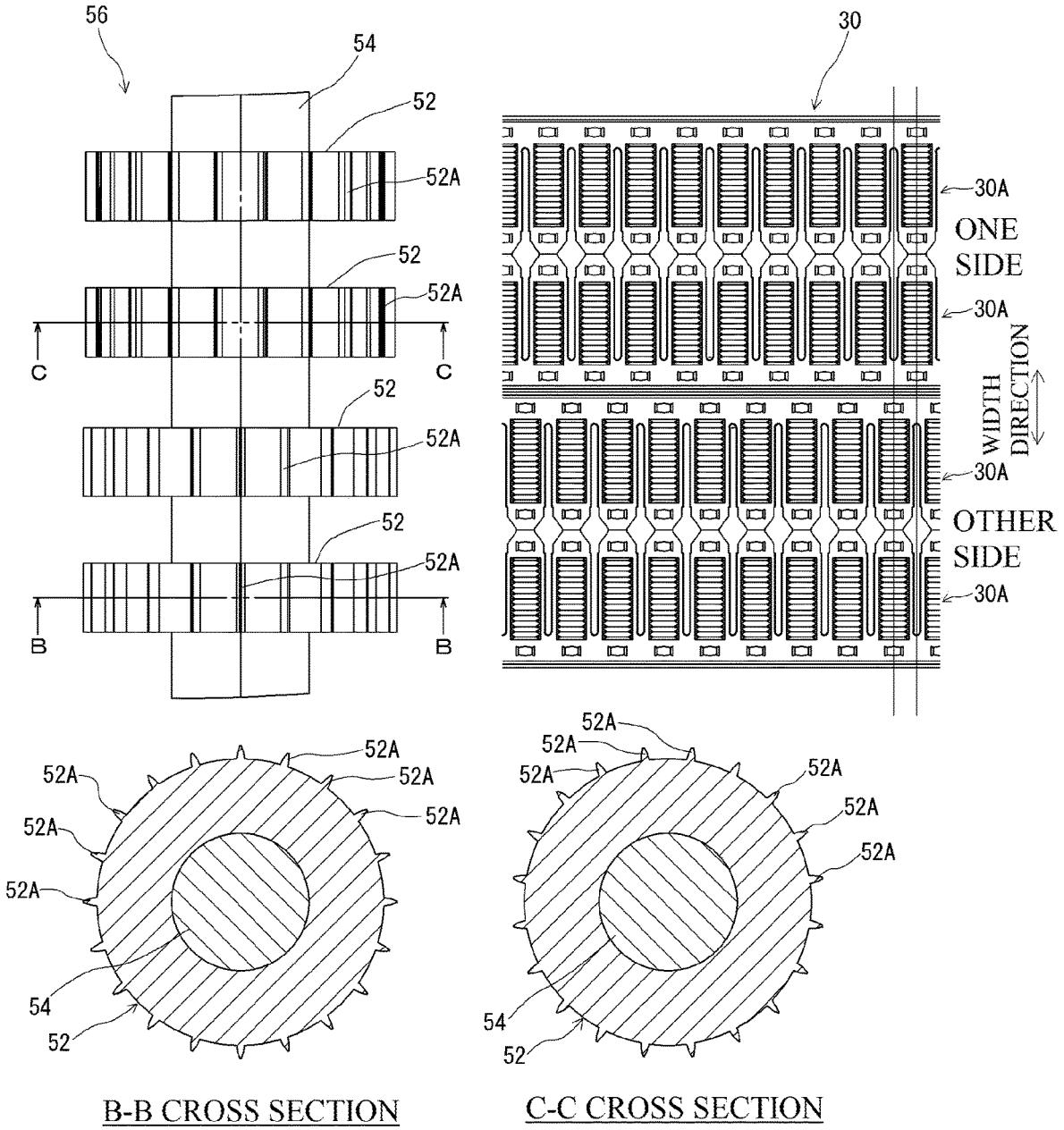
FIG. 9 is a plan view depicting a metal strip and a conveying unit according to a second embodiment.
Figure 10:
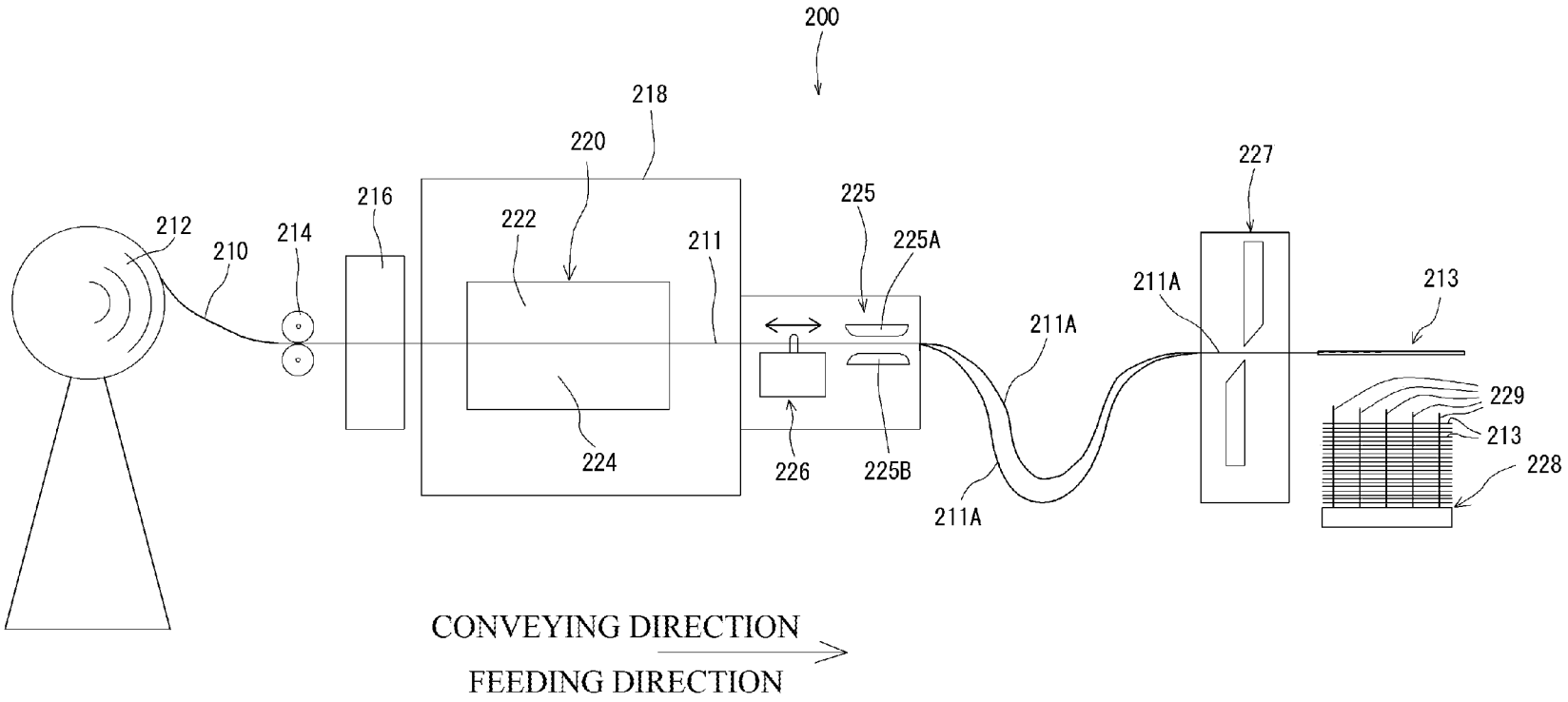
FIG.10 PRIOR ART
FIG. 10 is a side view of a heat exchanger fin manufacturing apparatus according to the conventional art.

FIG. 9 is a plan view of a principal part of a metal strip 30 according to a second embodiment. As depicted in FIG. 9, in the width direction of the metal strip 30 that is perpendicular to the conveying direction of the metal strip 30, the formation pitch of products (metal strips of the product width 30A) on one side (i.e., the upper half in FIG. 9) does not match the formation pitch of products on the other side (i.e., the lower half in FIG. 9) and is offset (shifted) by a distance that is equivalent to half of the product length in the conveying direction. The configuration of the conveying units 50 that correspond to the positions of the tube insertion portions 31 of this type of metal strip 30 is characteristic to this embodiment.

More specifically, the disposed positions of the protrusions 52A along the length directions of the rotating shafts 54 are shifted between a range equivalent to the front half in the length direction of the rotating shafts 54 and a range in the other half. In yet more detail, when looking along the length direction of the rotating shafts 54, the positions of the protrusions 52A in the circumferential direction of the rotating discs 52 are aligned in each of the front end halves and the other halves of the rotating shafts 54.

That is, positions of peaks (i.e., the disposed positions of the protrusions 52A) in the outer circumferential surface of the rotating discs 52 in the front-end half of a rotating shaft 54 are aligned with the positions of the troughs (i.e., intermediate positions between the protrusions 52A) in the outer circumferential surface of the rotating discs 52 in the other half. If two of the rotating shafts 54 with attached rotating discs 52 depicted in FIG. 9 are disposed at the required interval in the conveying direction of the metal strip 30, it is possible to obtain the same effects as the first embodiment.

Although the conveying apparatus 40 for a molded body for heat exchanger fins according to the present invention has been described above with reference to the above embodiments, the technical scope of the present invention is not limited to the embodiments described above. As one example, the form of the heat exchanger fins 30B is not limited to the form of the heat exchanger fins 30B for flattened fins that are obtained by fragmentation of the metal strip 30 depicted in FIG. 2. In more detail, it is also possible to apply the present invention to "round tube-type" heat exchanger fins in which the through-holes through which heat exchanger tubes will be inserted are formed with a shape that is symmetrical about a center line in the length direction (the conveying direction).

Although a configuration where the metal strip 30 is a so-called "ribbon-type" where a plurality of metal strips of the product width 30A are formed in a direction that is perpendicular to the conveying direction on the conveying plane has been described in the above embodiments, it is also possible to apply the present invention to a conveying apparatus 40 for a so-called fin per stroke type where a single metal strip of the product width 30A is formed in a direction that is perpendicular to the conveying direction on the conveying plane. In a manufacturing apparatus for a molded body for heat exchanger fins 100 for fin per stroke type heat exchanger fins, the inter-row slit apparatus 70 can be omitted. It is also possible for the rotating conveyor 56 to use an appropriate shape in keeping with the shape of the heat exchanger fins to be manufactured.

Also, although a configuration where the conveying apparatus 40 is constructed by conveying units 50 with two axes is described in the embodiments above, the present invention is not limited to this. It is possible for the conveying apparatus 40 to use a configuration where three or more conveying units 50 are disposed along the conveying direction of the metal strip 30. Also, so long as the intervals for disposing the conveying units 50 correspond to product intervals of the metal strip 30, the intervals do not need to be uniform intervals. That is, it is sufficient for the rotating operations (i.e., the rotating speeds) of the rotating conveyors 56 of the plurality of conveying units 50 that construct the conveying apparatus 40 to be subject to operation control by the operation control unit 90 so as to be synchronized.

Also, although the present embodiments use an arrangement where a so-called timing belt is used as the drive belt 57A, which is suspended on the timing pulleys 57B attached to the rotating shafts 54 and between the idler pulleys 57C and the tensioner pulley 57D that are attached to the pulley holder P, the present embodiments are not limited to this arrangement. As one example, it is also possible to use an arrangement where a timing belt is used as the drive belt 57A and gears that mesh with the timing belt are directly formed on the outer circumferential surfaces of the rotating shafts 54. With this arrangement, it is possible to omit the timing pulleys 57B, which is favorable in that it is possible to make the rotating shafts 54 lighter.

Also, although the rotating shafts 54 and the rotating conveyor driving units 58 are coupled via the cam indexes 59 in the embodiments described above, it is also possible to directly couple the rotating shafts 54 and the rotating conveyor driving units 58.

Also, although in the embodiments described above, the rotating conveyors 56 use a configuration where rotating discs 52 on which the protrusions 52A are formed are attached to a rotating shaft 54, it is also possible to use a rotating conveyor 56 configuration where convexes and concaves are formed in the outer circumferential surface of the rotating shaft 54 (i.e., the rotating shaft 54 is shaped with large diameter portions and small diameter portions) and the convexes (i.e., large diameter portions) function as the protrusions 52A.

In addition, although a configuration has been described where the insertion angle of the protrusions 52A that advance into the tube insertion portions 31 of the metal strip 30 is upright and perpendicular to the conveying plane when the operation in one cycle of intermittent feeding of the metal strip 30 of the manufacturing apparatus for a molded body for heat exchanger fins 100 ends, the present invention is not limited to this configuration. The insertion angle of the protrusions 52A into the tube insertion portions 31 of the metal strip 30 may be set by calculating in advance, in keeping with the material and thickness of the metal strip 30, a range of angles where there is no deformation of the tube insertion portions 31 due to the restarting of rotational driving of the protrusions 52A when conveying of the metal strip 30 restarts, and then setting the insertion angle in this calculated range of angles.

It is also possible to use a configuration where the cam indexes 59 are not interposed when coupling the rotating shafts 54 and the rotating conveyor driving units 58 in the conveying units 50 and the operation control unit 90 instead performs operation control of the rotating conveyor driving units 58 so that pressing operations by the mold pressing unit 20 (i.e., intermittent feeding operations of the metal strip 30) and rotational driving operations of the rotating conveyor driving units 58 are synchronized.

It is also possible to configure a manufacturing apparatus for a molded body for heat exchanger fins 100 by appropriately combining all of the embodiments and modifications described above.

What is claimed is:

1. An apparatus for conveying a molded body for heat exchanger fins that conveys, when manufacturing heat exchanger fins in which through-holes into which heat exchanger tubes are inserted or cutaway portions into which flattened tubes for heat exchanging are inserted are formed, a molded body for heat exchanger fins in a predetermined direction at a stage after formation of the through-holes or the cutaway portions in a thin metal plate but before cutting into predetermined lengths in a conveying direction, the apparatus comprising:

a plurality of conveying units that are disposed along the conveying direction of the molded body for heat exchanger fins and each include a rotating conveyor that has a plurality of tapered protrusions that are capable of advancing into the through-holes or the cutaway portions and has a rotating shaft in a direction that is perpendicular, on a horizontal plane, to the conveying direction of the molded body for heat exchanger fins, and a rotating conveyor driving unit that rotationally drives the rotating conveyor about the rotating shaft; and an operation control unit that controls the plurality of rotating conveyor driving units so as to synchronize rotational speeds between the plurality of conveying units, wherein in conveying units that are adjacent in the conveying direction of the molded body for heat exchanger fins, the rotating conveyor driving units are disposed at alternating positions in a direction that is perpendicular on the horizontal plane to the conveying direction of the molded body for heat exchanger fins, and for rotating conveyors that are adjacent in the conveying direction of the molded body for heat exchanger fins, a power transmitting body is suspended between one end of one rotating conveyor and another end of another rotating conveyor.

2. The apparatus for conveying a molded body for heat exchanger fins according to claim 1, wherein a value of a difference in angular phase of the protrusions that advance into the through-holes or the cutaway portions of the molded body for heat exchanger fins between conveying units that are adjacent in the conveying direction of the molded body for heat exchanger fins is equal to a value produced by dividing an angular interval of the protrusions formed on each rotating conveyor by a disposed number of the conveying units.

3. The apparatus for conveying a molded body for heat exchanger fins according to claim 1, further comprising a lower guide plate that supports a lower surface of the molded body for heat exchanger fins and an upper guide plate that covers an upper surface of the molded body for heat exchanger fins.

4. The apparatus for conveying a molded body for heat exchanger fins according to claim 1, wherein during intermittent feeding of the molded body for heat exchanger fins, when a rotating conveyor driving unit has completed an operation in one cycle, the protrusions are inserted in a direction perpendicular to a conveying plane at least one position out of the through-holes or cutaway portions of the molded body for heat exchanger fins.

5. The apparatus for conveying a molded body for heat exchanger fins according to claim 1, wherein a value produced by dividing the angular interval of the protrusions on each rotating conveyor by the disposed number of conveying units is 14° or below.

6. The apparatus for conveying a molded body for heat exchanger fins according to claim 1, wherein each rotating conveyor driving unit is a servo motor.

7. The apparatus for conveying a molded body for heat exchanger fins according to claim 1, wherein side surfaces of the protrusions are formed in a shape that is capable of advancing into the through-holes or the cutaway portions in synchronization with rotation of the rotating shafts while maintaining a gap from the through-holes or the cutaway portions and capable of withdrawing from the through-holes or the cutaway portions while contacting the through-holes or the cutaway portions to convey the molded body for heat exchanger fins.

8. The apparatus for conveying a molded body for heat exchanger fins according to claim 7, wherein at least part of the side surfaces of each protrusion is formed by involute curves.

9. The apparatus for conveying a molded body for heat exchanger fins according to claim 1, wherein a distance between the rotating shafts is a value calculated as $P1\times(M+1/N)$, where P1 is a product pitch of the heat exchanger fins on the molded body for heat exchanger fins, M is an arbitrary integer, and N is a number of the rotating shafts.

* * * * *